US009597568B2

(12) United States Patent
Holgate

(10) Patent No.: US 9,597,568 B2
(45) Date of Patent: Mar. 21, 2017

(54) TARGET FOR A THROWN OBJECT WITH RAPID DEPLOY FEATURES

(71) Applicant: Michael S. Holgate, Asheville, NC (US)

(72) Inventor: Michael S. Holgate, Asheville, NC (US)

( * ) Notice: Subject to any disclaimer, the term of this patent is extended or adjusted under 35 U.S.C. 154(b) by 0 days.

(21) Appl. No.: 13/953,996

(22) Filed: Jul. 30, 2013

(65) Prior Publication Data

US 2016/0317889 A1 Nov. 3, 2016

(51) Int. Cl.
*A63B 63/04* (2006.01)
*A63B 63/00* (2006.01)

(52) U.S. Cl.
CPC ..... *A63B 63/007* (2013.01)

(58) Field of Classification Search
CPC ..... A63B 67/06; A63B 63/00; A63B 63/007
USPC ..... 273/348, 398, 400; 473/476
See application file for complete search history.

(56) References Cited

U.S. PATENT DOCUMENTS 611,504 A * 9/1898 Perky ..... A63B 67/06 273/400
4,792,143 A * 12/1988 Headrick ..... A63B 67/06 273/400
5,358,255 A * 10/1994 Jolson ..... A63B 67/06 273/400
5,921,551 A * 7/1999 Dunipace ..... A63B 67/06 273/400
6,250,635 B1 * 6/2001 Chittenden ..... A63B 67/06 273/400
6,494,455 B1 * 12/2002 Headrick ..... A63B 63/00 273/400
6,776,417 B1 * 8/2004 Holgate ..... A63B 67/06 273/400
6,948,713 B1 * 9/2005 Grunfeld ..... A63B 67/06 273/400
7,500,675 B2 * 3/2009 Sandman ..... A63B 63/08 273/400
7,621,536 B2 * 11/2009 Orzech ..... A63B 63/00 273/400
2001/0033057 A1 * 10/2001 Chittenden ..... A63B 67/06 273/400
2003/0025272 A1 * 2/2003 Billig ..... A63B 63/00 273/400
2004/0077255 A1 * 4/2004 Tarng ..... A63B 65/10 446/46

(Continued)

*Primary Examiner* — Raleigh W Chiu
(74) *Attorney, Agent, or Firm* — The Van Winkle Law Firm; William G. Heedy; David M. Carter

(57) ABSTRACT

A target device for registering a hit by a thrown object such as a flying disc is provided and includes a pylon assembly, an interceptor, and a receipt component. The pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

18 Claims, 11 Drawing Sheets

(56) References Cited

U.S. PATENT DOCUMENTS

| | | | | |
|---|---|---|---|---|
| 2005/0282665 | A1* | 12/2005 | Tarng | A63B 59/20 473/465 |
| 2008/0139343 | A1* | 6/2008 | Sandman | A63B 63/08 473/478 |
| 2008/0153633 | A1* | 6/2008 | Orzech | A63B 63/00 473/472 |
| 2009/0143175 | A1* | 6/2009 | Tarng | A63B 43/02 473/470 |
| 2010/0013160 | A1* | 1/2010 | Tarng | A63B 63/00 273/317.2 |
| 2014/0265137 | A1* | 9/2014 | Gradinger | A63B 67/06 273/400 |
| 2015/0283440 | A1* | 10/2015 | Ruedin | A63B 67/06 473/476 |
| 2015/0367216 | A1* | 12/2015 | Todd | A63B 67/06 273/400 |

* cited by examiner

TARGET FOR A THROWN OBJECT WITH RAPID DEPLOY FEATURES

BACKGROUND OF THE INVENTION

There are several sport and recreational activities that involve throwing a ball, disc, or other object toward a target. The target can, in a simple configuration, merely be a visual landmark toward which a person throws the thrown object or the target can additionally function to intercept and/or even intercept and then retain the thrown object. Disc golf is a popular activity in which a person throws a flying disc at a target that intercepts the disc—typically, in a manner that decelerates the forward flight path motion of the disc—and the target then retains the disc in a collection basket that catches the now decelerated downwardly falling disk. A number of disc golf intercepting targets can be arranged in an open playing area in a layout simulating the layout of a traditional golf course, although usually at relatively smaller distances and the disc golf player makes consecutive throws towards each target until the disc is intercepted and retained by the target itself.

A common configuration of a disc golf target often includes a vertical support structure supporting a collection basket and a number of free hanging chains disposed above the collecting basket. The chains are functionally arranged to effectively catch a flying disc by absorbing the disc's kinetic energy, with the disc thereafter dropping into the basket. Disc golf target assemblies are typically stationary, with a lower end of the vertical support structure extending from a base, such as a pedestal, concrete pad or tripod. The base in some configurations may be a concrete or masonry base anchored to the ground and in other configurations the base may designed to rest on the ground and thus permit some degree of portability to the disc golf target. Additionally, there are disc golf target arrangements that are particularly configured to be of reduced weight and that have some degree of collapsibility so that a user can more readily transport and store the disc golf target. For example, U.S. Pat. No. 6,776,417 to Holgate depicts one such collapsible and readily deployable disc golf target.

While portable target kits such as the portable disc golf target kits provide greater opportunities for a person to practice target throwing skills, it is nonetheless believed that even more people may enjoy the play of target games such as disc golf if the convenience and portability of target interceptor products can be improved. Furthermore, more people may be willing to try such a target interceptor product if the product could be set up for play in a few simple steps and, additionally, if the product could be easily stored by breaking it down quickly from its set up position. Moreover, parents, sports coaches, and others may see that more sport and recreational settings such as, for examples, park or school settings, are suitable for target play activities if appropriate target interceptor products are offered that are easy to carry and easy to store.

SUMMARY OF THE INVENTION

A need therefore exists for a system that eliminates or diminishes the disadvantages and problems described above.

One object of the present invention is to provide a target interceptor that is easy to carry and easy to store.

A further object of the present invention is to provide a target interceptor that promotes safe operation in that it minimizes the risk that the support base of the target interceptor can be deployed in an unstable manner. The target interceptor of the present invention achieves this safety benefit in that its support base deploys to a spread out disposition in an automatic manner without the need for the user to make a guess as to whether the support base has been fully spread.

Yet another object of the present invention is to provide a target interceptor that can be carried by a person in an ergonomically friendly manner and can be deployed with a minimum of assembly.

According to one aspect of the present invention, there is provided an engagement apparatus for engaging a thrown object such as a flying disc and the engagement apparatus includes a pylon assembly and a surface presenting component. The pylon assembly has a first riser section and a second riser section and the pylon assembly has an axis and has a base axial end and a distal axial end, the first riser section delimiting the base axial end and the second riser section delimiting the distal axial end, and the first riser section and the second riser section being disposable between a stowage disposition in which the first riser section and the second riser section are at least partially co-extensive with one another relative to the axial direction and together delimit a stowage axial length measured from the base axial end delimited by the first riser section to the distal axial end delimited by the second riser section, and an operating disposition in which the first riser section and the second riser section collectively extend to an operating length greater than the stowage axial length. The surface presenting component is operable to present a surface on which a thrown object can be engaged and has a mounting portion.

In accordance with one enhancement, the engagement apparatus also includes a traveler that is operable to movably couple the mounting portion of the surface presenting component to the pylon assembly, the traveler guiding a movement of the surface presenting component relative to the pylon assembly in which the surface presenting component moves between a non-presenting position in which the mounting portion of the surface presenting component is at a first axial spacing from the base axial end of the pylon assembly and a presenting position in which the mounting portion of the surface presenting component is at a second axial spacing from the base axial end of the pylon assembly that is greater than the first axial spacing.

According to another aspect of the present invention, there is provided a catch device for catching a thrown object such as a flying disc and the catch device includes a pylon assembly, an interceptor, and a receipt component. The pylon assembly has a first riser section and a second riser section and the pylon assembly has an axis and a base axial end and a distal axial end, the first riser section and the second riser section being disposable between a stowage disposition in which the first riser section and the second riser section are at least partially co-extensive with one another relative to the axial direction and collectively extend to a stowage length and an operating disposition in which the first riser section and the second riser section collectively extend to an operating length greater than the stowage length. The receipt component has a receiving surface on which a thrown object is retained after the thrown object has been engaged by the interceptor. The interceptor and the receipt component are securable to the pylon assembly in the operating disposition of the pylon assembly such that the receipt component is axially intermediate the base axial end of the pylon assembly and the interceptor. Also, the interceptor is disposable between an intercepting position in which the interceptor extends radially from the pylon assembly to a projecting radial spacing and a non-intercepting position in which the interceptor extends from the pylon assembly to a lesser radial spacing than the projecting radial spacing. The receipt component is disposable between a flared position in which the receipt component extends radially from the pylon assembly to a flared radial spacing and a pack position in which the receipt component extends from the pylon assembly to a lesser radial spacing than the flared radial spacing. The pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

According to a further aspect of the present invention, there is provided an engagement apparatus for engaging a thrown object such as a flying disc and the engagement apparatus includes a pylon assembly, an interceptor, and a traveler operable to movably couple a mounting portion of the interceptor to the pylon assembly.

BRIEF DESCRIPTION OF THE DRAWINGS

Other features and advantages of the invention will become apparent to those skilled in the art upon review of the following detailed description, claims, and drawings.

DETAILED DESCRIPTION OF AN EMBODIMENT

Figure 1:
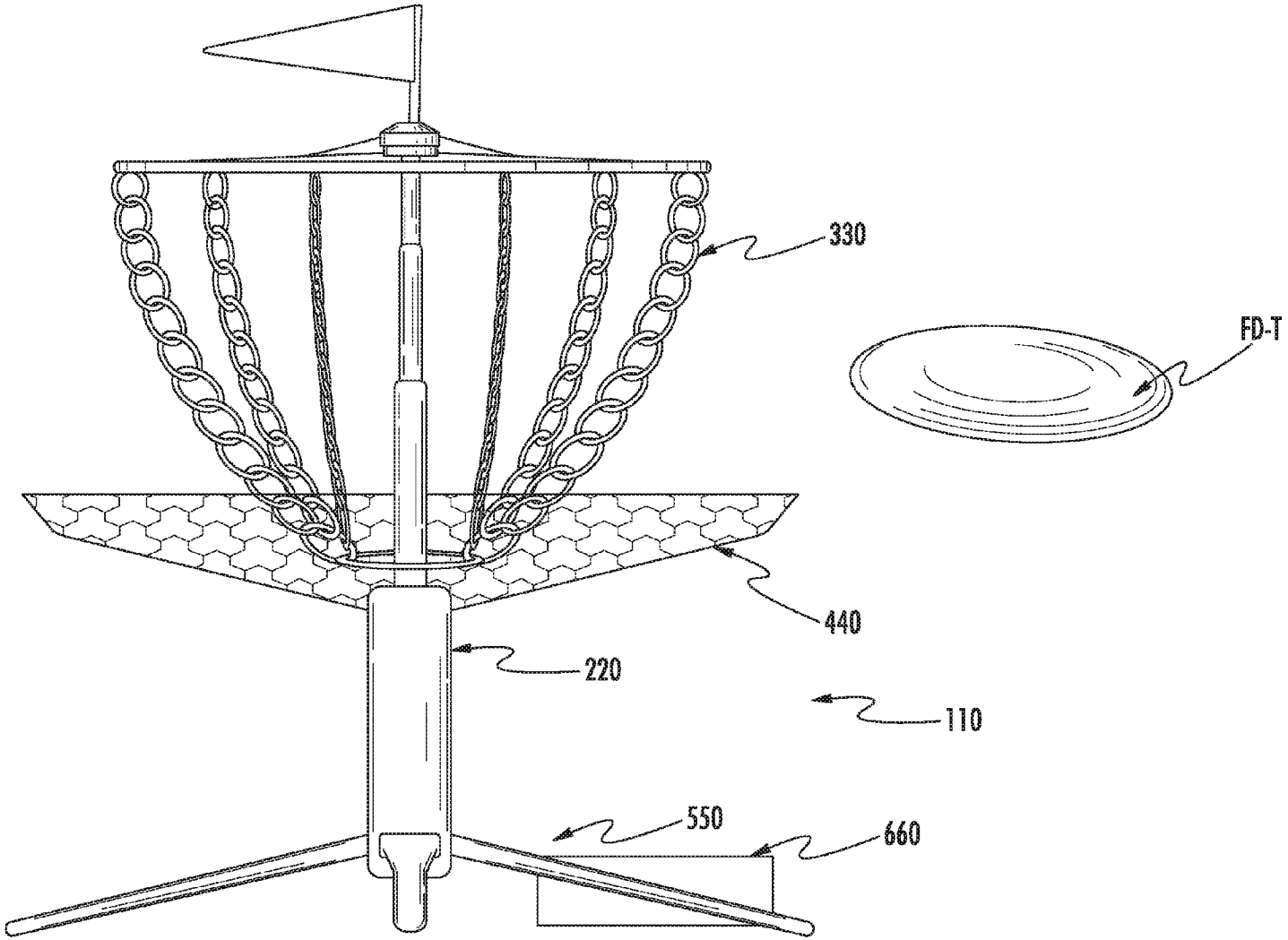
FIG. 1 is a perspective view of the one embodiment of the engagement apparatus for engaging a thrown object of the present invention.
Figure 2:
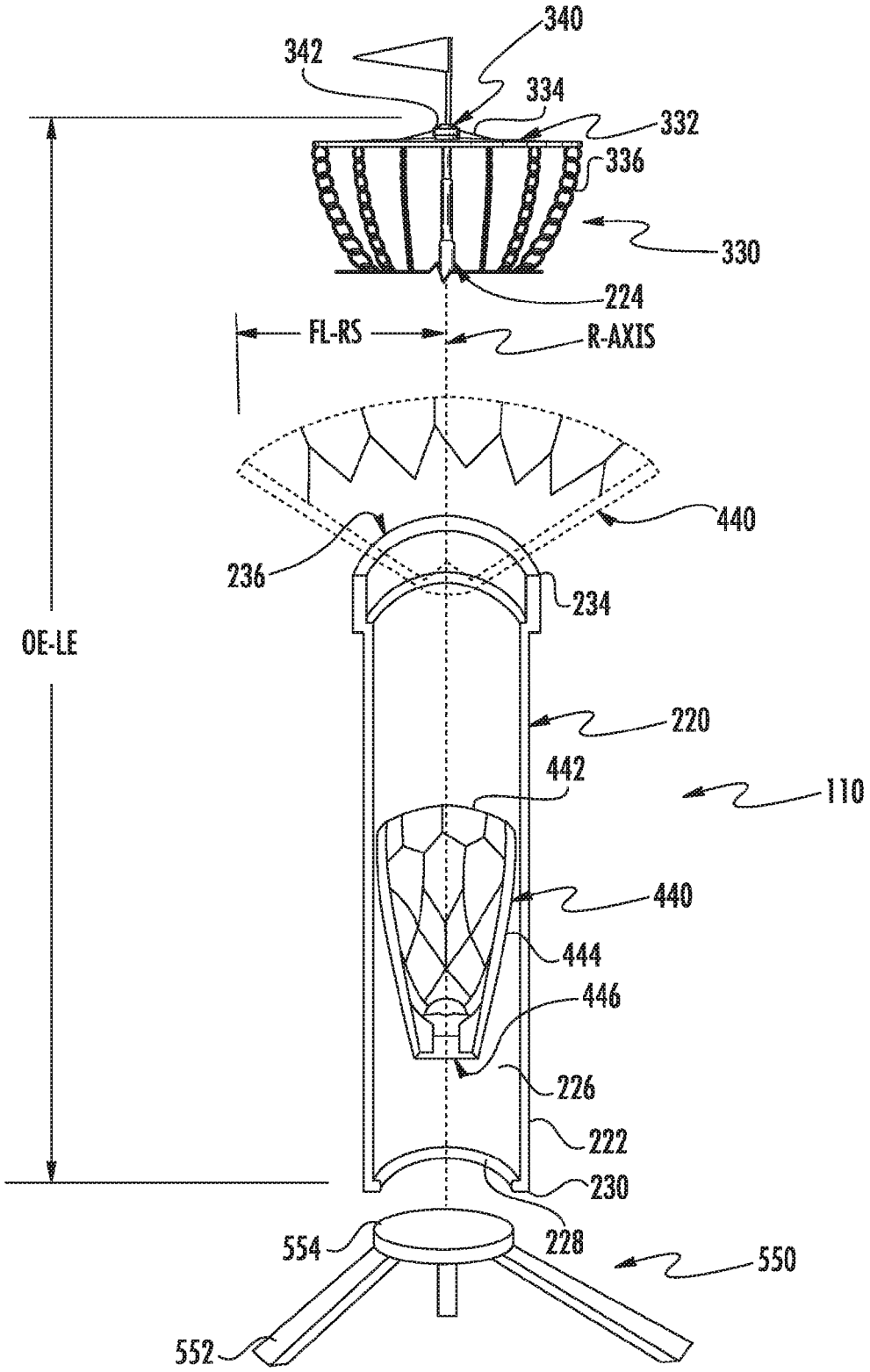
FIG. 2 is a sectional perspective view of the catch device shown in FIG. 1.

As seen in FIGS. 1-3, one embodiment of the engagement apparatus for engaging a thrown object of the present invention is directed to a catch device 110 for catching a thrown object such as a flying disc FD-T. The term "engagement apparatus" is intended to apply to any structure that provides a target toward which an object can be directed and one type of "target" can be in the form of a "target interceptor" which is intended to apply to any structure that provides a target toward which an object can be directed and that influences the movement of the object in that the structure accelerates or decelerates the object or changes the direction of movement of the object. The term "thrown object" as used herein is intended to mean any object that is moving through any medium including, for example, air or water.

As seen in FIG. 1, which is a perspective view of the one embodiment of the engagement apparatus for engaging a thrown object of the present invention, the catch device 110 includes a pylon assembly 220, an interceptor 330, and a receipt component 440, and the catch device 110 may optionally include a ground support assembly 550 and a convenience assembly 660. The catch device 110 is convertible between a target deployment mode and a carry case mode, as will be described in more detail herein.

As seen in FIG. 2, which is a sectional partially exploded perspective view of the catch device shown in FIG. 1, the pylon assembly 220 has a first riser section 222 and a second riser section 224 and the pylon assembly 220 has an axis R-AXIS. The first riser section 222 is exemplarily formed as an elongate tube having a hollow interior delimited by an inner surface 226 having an overall cylindrical shape. The first riser section 222 can be formed, for example, of injection molded or extruded polymeric materials or plastic and can be fully rigid, semi-rigid, or substantially non-rigid.

The first riser section 222 has a radially inwardly extending lip 228 at a first axial end 230 and this lip 228 delimits a base axial end of the pylon assembly 220. This second axial end 234 of the first riser section 222 has a plurality of circumferentially equally spaced notches 236 each one of which extends radially from the inner surface 226 of the first riser section 222 to its outer surface. These notches 236 assist in ensuring a stable deployment of the receipt component 440 in a target deployment mode of the catch device 110, as will be described in more detail herein.

The ground support assembly 550 includes a plurality of collapsible legs 552 that are hingedly commonly connected to an annular mounting disk 554. The legs 552 are movable between a collapsed disposition in which the legs 552 nest with one another in a reduced width closely adjacent manner and a leg extended disposition (shown in FIG. 2) in which the free ends of the legs are pivoted outward to a maximum extent. The annular mounting disk 554 has a diameter selected in coordination with the inner diameter of the first riser section 222 at its first axial end 230 such that this first axial end 230 of the first riser section 222 can be inserted in a relatively close friction fit manner onto the annular mounting disk 554 when the legs 552 of the ground support assembly 550 are extended in the leg extended disposition and this results in a configuration in which the first riser section 222 extends vertically from the ground support assembly 550 and is supported thereon in a selectively releasable yet stable manner.

The second riser section 224 includes a post 250 (shown in FIG. 3A but omitted in FIG. 2 for the sake of clarity) and the post 250 has a first axial end fixedly secured axially centrally to a canopy traveler 252. The second axial end of the second riser section 224, which is axially opposite to its first axial end, delimits a distal axial end of the pylon assembly 220.

The interceptor 330 is shown in FIGS. 1 and 2 is exemplarily formed of a plurality of runners 332, a plurality of connector arms 334 equal in number to the number of runners 332, a plurality of chain link segments 336 equal in number to the number of runners 332, and a collar chain 338. Accordingly, if, for example, there are a total of twelve individual runners 332, then there are also a total of twelve individual connector arms 334 and a total of twelve individual chain link segments 336, with each respective chain link segment 336 and each respective connector arm 334 being associated with a given one of the runners 332. One end of each chain link segment 336 is connected to its associated runner 332 and the other end of the chain link segment is connected to the collar chain 338. A home base ring 340 is fixedly secured to the post 250 of the second riser section 224 at a predetermined axial spacing between the axial ends of the second riser section 224. The second riser section 224 includes a top axial end 342 that may serve as a support for an optional flag or banner, to be described in more detail herein. The respective end of each runner 332 opposite to its end at which the associated chain link segment 336 is connected is hingedly connected to the home base ring 340. One end of each connector arm 334 is connected to its associated runner 332 about mid-way along the longitudinal extent of the runner and the other end of the connector arm is hingedly connected to the canopy traveler 252. When the canopy traveler 252 is moved axially toward the home base ring 340, this causes the connector arms 334 to exert radially outward force on the runners 332 and thus move the runners 332 into their greatest radial extent in the intercepting position of the interceptor 330. Conversely, when the canopy traveler 252 is moved away from the home base ring 340, this causes the connector arms 334 to exert radially inward force on the runners 332 and thus move the runners 332 to a lesser radial spacing in the non-intercepting position of the interceptor 330. Although the interceptor 330 has been described as having the collar chain 338, the present invention also contemplates that the interceptor can be configured without the collar chain 338, or any other structure that directly or indirectly connects the lower portions of the chain link segments 336 to the catch device 110. Thus, each of the lower portions of the chain link segments 336 can be configured as a free end that moves independent of the other lower portions of the chain link segments. In this connection, each of the lower portions of the chain link segments 336 can be configured with an appropriate mass to ensure that the lower portion of the chain link segment hangs substantially without interfering with the downward suspension of adjacent lower portions of the chain link segments 336 or each of the lower portions of the chain link segments 336 can be configured with a reduced mass for other purposes, such as, for example, for the purpose of improving the thrown object intercepting properties of the interceptor.

As seen in FIG. 2, the interceptor 330 is configured to operate in the manner of an umbrella in that the runners 332 extend to their greatest radial extent in the target deployment mode of the catch device 110 and this results in the chain link segments 336 each hanging in a slight radially inward arc between the runners 332 and the collar chain 338. As seen in FIG. 3A, which is a sectional perspective view of the catch device 110 in its carry case mode, the interceptor 330 is configured to operate in the manner of a folded or collapsed umbrella in that the runners 332 no longer extend to their greatest radial extent but, instead, each forms a more acute angle with the post 250 of the second riser section 224 than in its fully radially extended position. This is achieved via axial movement of the canopy traveler 252 away from the cap 340, thereby causing the connector arms 334 to radially inwardly retract the runners 332. Thus, it can be understood that the interceptor 330 is disposable between an intercepting position in which the interceptor extends radially from the pylon assembly 220 to a projecting radial spacing (i.e., the runners 332 extend to their greatest radial extent in the target deployment mode of the catch device 110) and a non-intercepting position in which the interceptor extends from the pylon assembly 220 to a lesser radial spacing than the projecting radial spacing.

As seen in FIG. 2 and as seen in FIG. 3A, which is a sectional perspective view of the catch device 110 in its carry case mode, the pylon assembly 220 and the interceptor 330 are operatively associated with one another such that the catch device 110 can be easily and reliably converted between its target deployment mode and its carry case mode. In connection with disposing the catch device 110 in its carry case mode, the first riser section 222 and the second riser section 224 are disposable in a stowage disposition of the pylon assembly 220 in which the first riser section 222 and the second riser section 224 are at least partially co-extensive with one another relative to the axial direction (I.e., as viewed relative to the axis R-AXIS) and collectively extend to a stowage length and are disposable in an operating disposition of the pylon assembly 220 in which the first riser section 222 and the second riser section 224 collectively extend to an operating length greater than the stowage length. As seen in FIG. 3A, the first riser section 222 and the second riser section 224, in the stowage disposition of the pylon assembly 220, are at least partially co-extensive with one another relative to the axial direction along a stowage overlap extent SOE. Also as seen in FIG. 3A, the first riser section 222 and the second riser section 224 collectively extend to a stowage length ST-LE when the catch device 110 in its carry case mode, as measured from the top axial end 342 of the second riser section 224 to the first axial end 230 of the first riser section 222.

In connection with disposing the catch device 110 in its target deployment mode, the first riser section 222 and the second riser section 224 are disposable to collectively extend to an operating length greater than the stowage length, in each instance as measured from the top axial end 342 of the second riser section 224 to the first axial end 230 of the first riser section 222. FIG. 2 shows that the first riser section 222 and the second riser section 224 collectively extend to an operating length OE-LE greater than the stowage length ST-LE.

Referring again to FIG. 2, the receipt component 440 has a receiving surface 442 on which a thrown object such as, for example, the flying disk FD-T, is retained after the thrown object has been engaged by the interceptor 330. The receiving surface 442 of the receipt component 440 can be exemplarily formed of a woven or non-woven synthetic textile material supported on a plurality of basket members 444. The receipt component 440 is positioned relative to the interceptor 330 such that the thrown objects engaged by the chain link segments 336 of the interceptor can fall under the action of gravity on a downward path and then impact the receiving surface 442 of the receipt component 440. Thus, the interceptor 330 and the receipt component 440 are securable to the pylon assembly 220 in the operating disposition of the pylon assembly 220 such that the receipt component 440 is axially intermediate the base axial end of the pylon assembly 220 and the interceptor 330. A portion of the receipt component 440 is shown in solid lines in FIG. 2 to exemplarily show the position of the receipt component 440 in the carry case mode of the catch device 110 and this same portion of the receipt component 440 is shown in broken lines in FIG. 2 to exemplarily show the position of the receipt component 440 in the target deployment mode of the catch device 110.

Each basket member 444 of the receipt component 440 has one end hingedly connected to a second traveler 446 that is in the form of an annular ring. The basket members 444 are mounted at equal circumferential spacings from one another around the annular periphery of the second traveler 446. The receipt component 440 is disposable between a flared position in which the receipt component extends radially from the pylon assembly 220 to a flared radial spacing FL-RS (shown in FIG. 2) and a pack position in which the receipt component 440 extends from the pylon assembly 220 to a lesser radial spacing NFL-RS that is less than the flared radial spacing (shown in FIG. 3A). In the flared position of the receipt component 440, the second traveler 446 has been axially advanced relative to the first riser section 222 such that the basket members 444 can extend radially outward beyond the first riser section 222. In this connection, it can be seen that the notches 236 in the second axial end 234 of the first riser section 222 are compatibly configured with respect to the basket members 444 to each receive a respective basket member therein as the basket member extends radially outwardly and this assists in maintaining and stabilizing the receipt component 440 in its flared position. As noted, the post 250 of the second riser section 224 has a first axial end fixedly secured axially centrally to the canopy traveler 252. A second axial end of the post 250 of the second riser section 224 is fixedly secured to the second traveler 446 of the receipt component 440. Thus, an axial movement of the post 205 of the second riser section 224 acts to move the second traveler 446 of the receipt component 440, whereupon a user can raise the post 250 of the second riser section 224 out of the first riser section 222 to bring the interceptor 330 into its intercepting position and this will correspondingly bring the receipt component 440 into a position in which its basket members 444 can be radially expanded into registry with the notches 236 at the top axial end of the first riser section 222 in connection with deploying the receipt component into its flared radial spacing FL-RS.

The pylon assembly 220, the interceptor 330, and the receipt component 440 are operatively associated with one another such that a movement of the pylon assembly 220 from its operating disposition to its stowage disposition operates to move the interceptor 330 and the receipt component 440 axially closer to the base axial end of the pylon assembly 220 and, (a) when the pylon assembly 220 is in its stowage disposition, (b) the interceptor 330 has been moved from its intercepting position into its non-intercepting position, and (c) the receipt component 440 has been moved from its flared position into its pack position, the interceptor 330 and the receipt component 440 at least partially axially overlap one another. The operative association of the pylon assembly 220, the interceptor 330, and the receipt component 440 with one another still obtains even if an individual component of the pylon assembly 220, the interceptor 330, and the receipt component 440 is moved or displaced axially in a manner which moves this individual component to a location that is not closer to the base axial end of the pylon assembly 220 but, instead, is further from the base axial end of the pylon assembly 220 during a movement of the pylon assembly 220 from its operating disposition to its stowage disposition. For example, the canopy traveler 252 is axially displaceable in an axial direction from the base axial end of the pylon assembly 220 toward the distal axial end of the pylon assembly 220 in connection with a movement of the interceptor 330 between its intercepting position in which the interceptor extends radially from the pylon assembly 220 to a projecting radial spacing and its non-intercepting position in which the interceptor extends from the pylon assembly 220 to a lesser radial spacing than the projecting radial spacing. Nonetheless, the interceptor 330 as a whole is axially shifted such that it is closer to the base axial end of the pylon assembly 220.

The first riser section 222 radially surrounds at least a portion of at least one of the interceptor 330 in its non-intercepting position or the receipt component 440 in its pack position, and, specifically in the variation shown in FIGS. 1-3A, the first riser section 222 radially surrounds both the entirety of the interceptor 330 in its non-intercepting position and the entirety of the receipt component 440 in its pack position. The first riser section 222 has an inner volume sufficient to accommodate the entirety of the interceptor 330 in its non-intercepting position and the entirely of the receipt component 440 in its pack position. In the interest of reducing the requisite volume needed within the first riser section 222 for accommodating the interceptor 330 and the receipt component 440, a selected one of the interceptor 330 and the receipt component 440 is configured to radially encircle at least a portion of the other one of the interceptor 330 and the receipt component 440. For example, as seen in FIG. 3A, the distal end portions of the runners 332 of the interceptor 330 can be radially encircled by the region of the receiving surface 442 of the receipt component 440 adjacent the distal end portions of the basket members 444 of the receipt component 440. To facilitate such a radial encirclement, the distal end portions of the runners 332 of the interceptor 330 and the distal end portions of the basket members 444 of the receipt component 440 may be arranged in an interdigitated manner with one another, thereby further reducing the volume requirement of the first riser section 222.

Figure 3B:
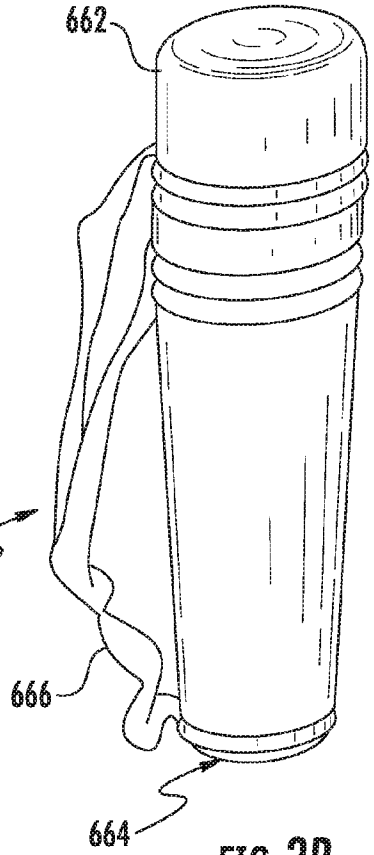
FIG. 3B is a top perspective view of an outer case version of the catch device shown in FIGS. 1-3.
Figure 3A:
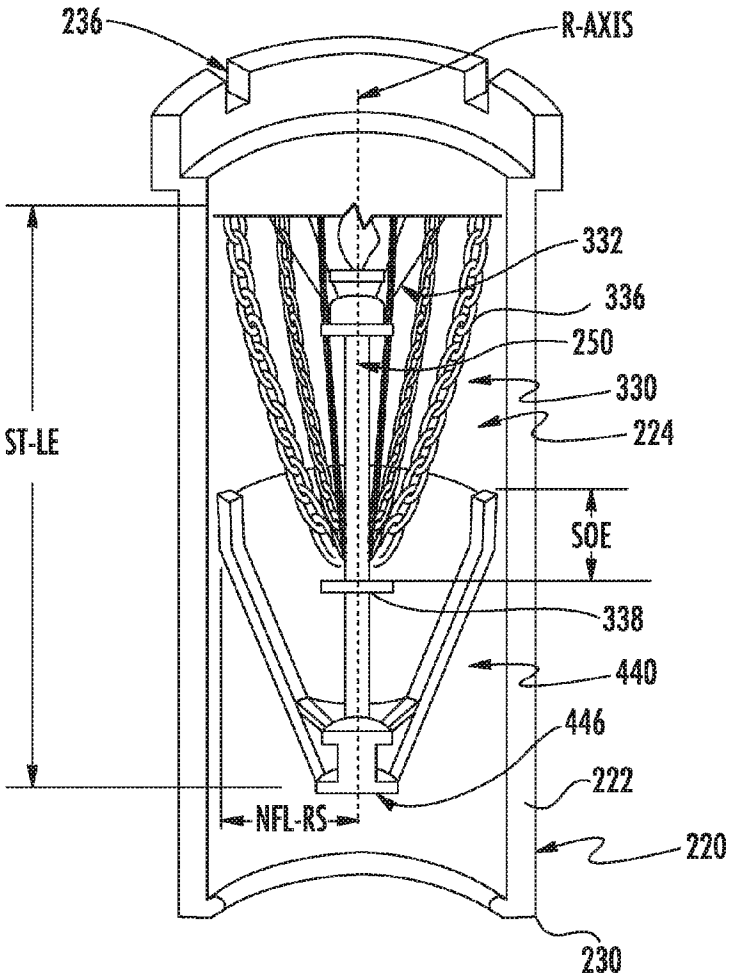
FIG. 3A is a sectional perspective view of the catch device shown in FIG. 1 in its carry case mode.

As seen in FIG. 3B, which is a top perspective view of an outer case version of the catch device shown in FIGS. 1-3A, the convenience assembly 660 includes a pair of overcaps 662, 664 connected to one another via a sling strap 666. The overcap 662 has an inner diameter sized in correspondence with the outer diameter of the first axial end 230 of the first riser section 222 such that the overcap can be removably mounted to the first riser section 222 in a friction fit manner. The overcap 662 thus provides a removable cover that minimizes or eliminates the risk that moisture, debris, or other unwanted matter enters the pylon assembly 220 via the respective axial end of the first riser section 222 (i.e., its first axial end 230). The overcap 664 has an inner diameter sized in correspondence with the outer diameter of the second axial end 234 of the first riser section 222 such that the overcap can be removably mounted to the first riser section 222 in a friction fit manner. The overcap 664 thus provides a removable cover that minimizes or eliminates the risk that moisture, debris, or other unwanted matter enters the pylon assembly 220 via the respective axial end of the first riser section 222 (i.e., its second axial end 234). The sling strap 666 has a length selected to permit both overcaps 662, 664 to be friction fit mounted to the pylon assembly 220 with a remainder slack in the sling strap being available for a person to sling the catch device 110 around a shoulder and thus conveniently carry the catch device.

Figure 4:
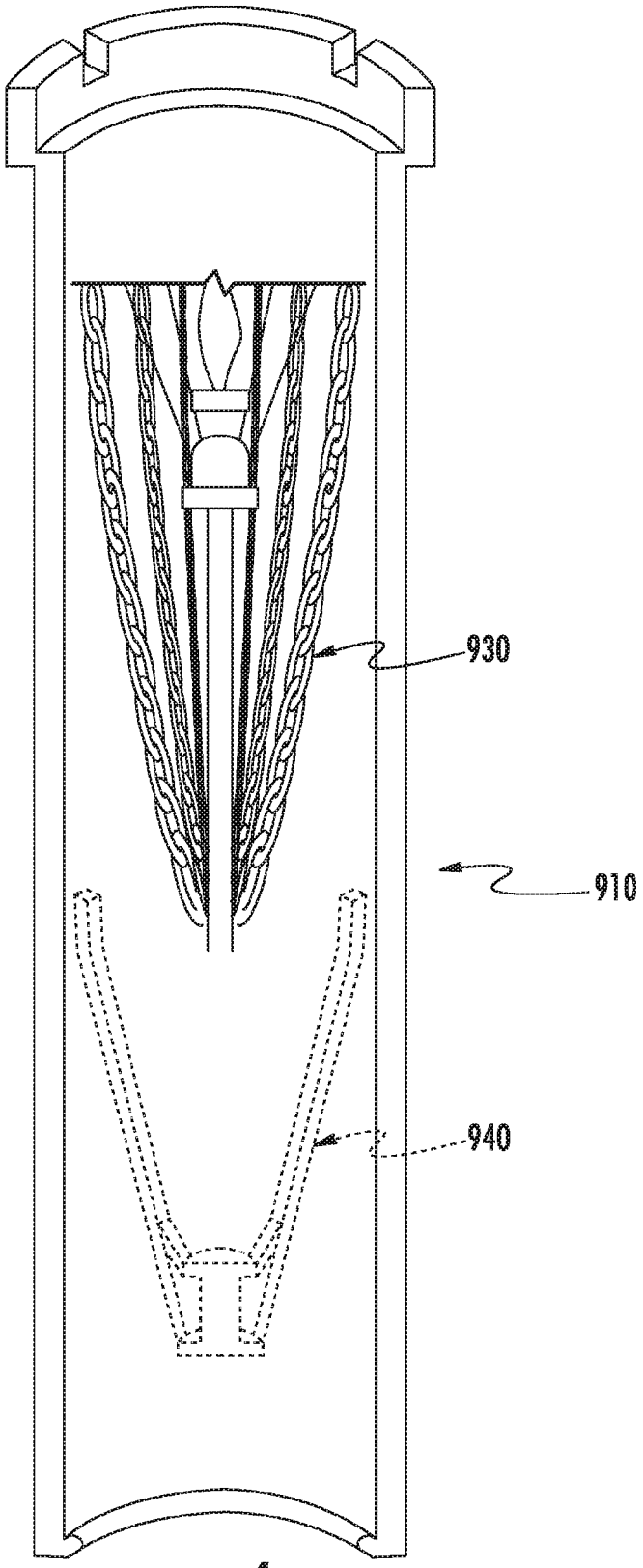
FIG. 4 is a sectional perspective view of a variation of the engagement apparatus of the present invention.

As seen in FIG. 4, which is a sectional perspective view of a variation of the engagement apparatus of the present invention, the engagement apparatus is in the form of a catch device 910 operable to engage a thrown object such as a flying disc and the engagement apparatus includes a pylon assembly, the pylon assembly having a first riser section and a second riser section and the pylon assembly having an axis and having a base axial end and a distal axial end, the first riser section and the second riser section being disposable between a stowage disposition in which the first riser section and the second riser section are at least partially co-extensive with one another relative to the axial direction and collectively extend to a stowage axial length and an operating disposition in which the first riser section and the second riser section collectively extend to an operating length greater than the stowage axial length, a surface presenting component, the surface presenting component being operable to present a surface on which a thrown object can be engaged, and a traveler operable to movably couple the surface presenting component to the pylon assembly, the traveler guiding a movement of the surface presenting component relative to the pylon assembly in which the surface presenting component moves between a non-presenting position in which the surface presenting component is at a first axial spacing from the base axial end of the pylon assembly and a presenting position in which the surface presenting component is at a second axial spacing from the base axial end of the pylon assembly that is greater than the first axial spacing.

With further reference to FIG. 4, the surface presenting component may be in the form of an interceptor 930 and can further include a receipt component 940, which is schematically shown in broken lines to emphasize that this component can be optional. The receipt component 940 has a receiving surface on which a thrown object is retained after the thrown object has been engaged by the interceptor, the interceptor in its presenting position extending radially from the pylon assembly to a protecting radial spacing and in its non-presenting position extending from the pylon assembly to a lesser radial spacing than the projecting radial spacing, and the interceptor and the receipt component being securable to the pylon assembly in the operating disposition of the pylon assembly such that the receipt component is axially intermediate the base axial end of the pylon assembly and the interceptor.

The receipt component is disposable between a flared position in which the receipt component extends radially from the pylon assembly to a flared radial spacing and a pack position in which the receipt component extends from the pylon assembly to a lesser radial spacing than the flared radial spacing and the pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another. The interceptor includes a plurality of chain link segments.

Figure 5:
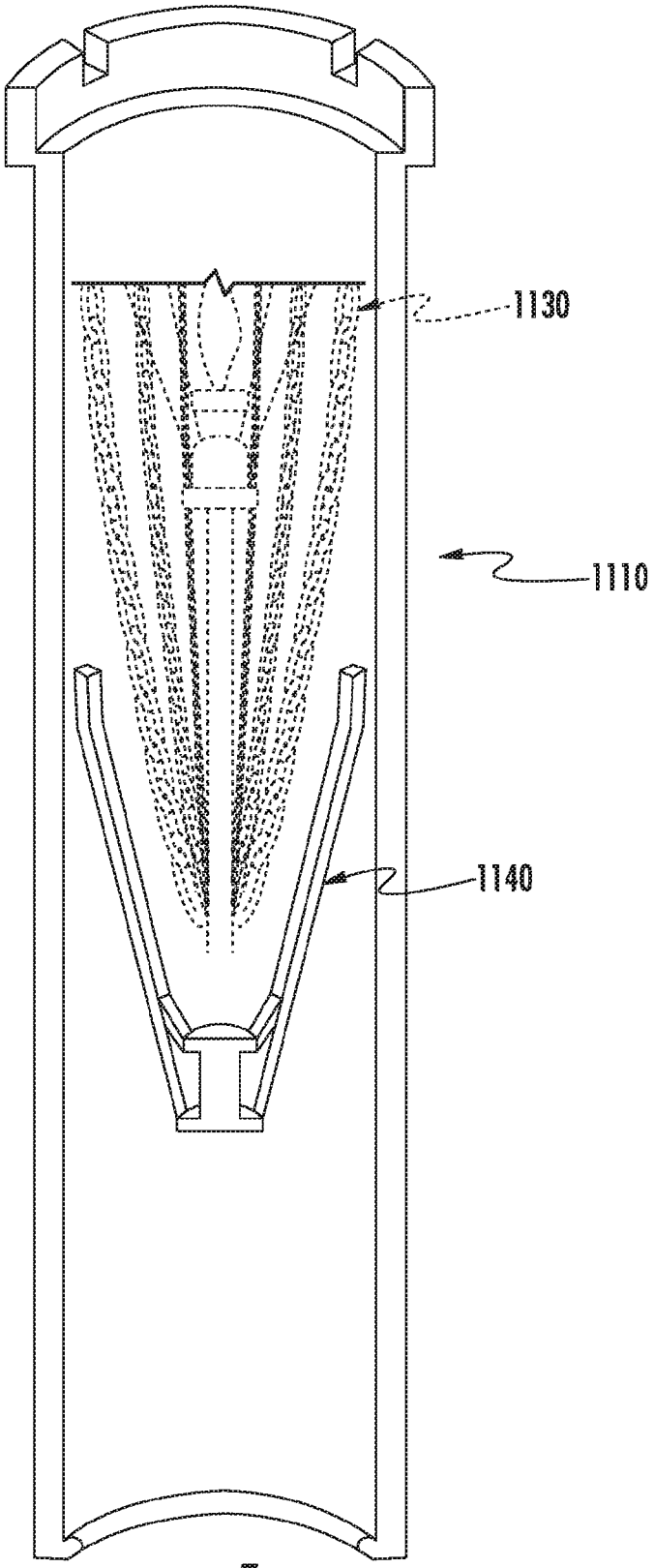
FIG. 5 is a sectional perspective view of a further variation of the engagement apparatus of the present invention.

As seen in FIG. 5, which is a sectional perspective view of a further variation of the engagement apparatus of the present invention, the engagement apparatus is in the form of a catch device 1110 operable to engage a thrown object such as a flying disc and the catch device 1110 includes a surface presenting component that is in the form of a receipt component 1140, the receipt component having a receiving surface on which a thrown object is retained after the thrown object has been engaged by the receipt component. The receipt component in its presenting position extends radially from the pylon assembly to a projecting radial spacing relative to the axis R-AXIS and in its non-presenting position extends from the pylon assembly to a lesser radial spacing than the projecting radial spacing. The engagement apparatus shown in FIG. 5 may also include, in addition to the receipt component 1140, an interceptor 1130, which is schematically shown in broken lines to emphasize that this component can be optional. The interceptor 1130 and the receipt component 1140 are securable to the pylon assembly in the operating disposition of the pylon assembly such that the receipt component is axially intermediate the base axial end of the pylon assembly and the interceptor.

With further reference to FIG. 5, the interceptor is disposable between an intercepting position in which the interceptor extends radially from the pylon assembly to a projecting radial spacing and a non-intercepting position in which the interceptor extends from the pylon assembly to a lesser radial spacing than the projecting radial spacing and the pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another. The interceptor includes a plurality of chain link segments.

Figure 7:
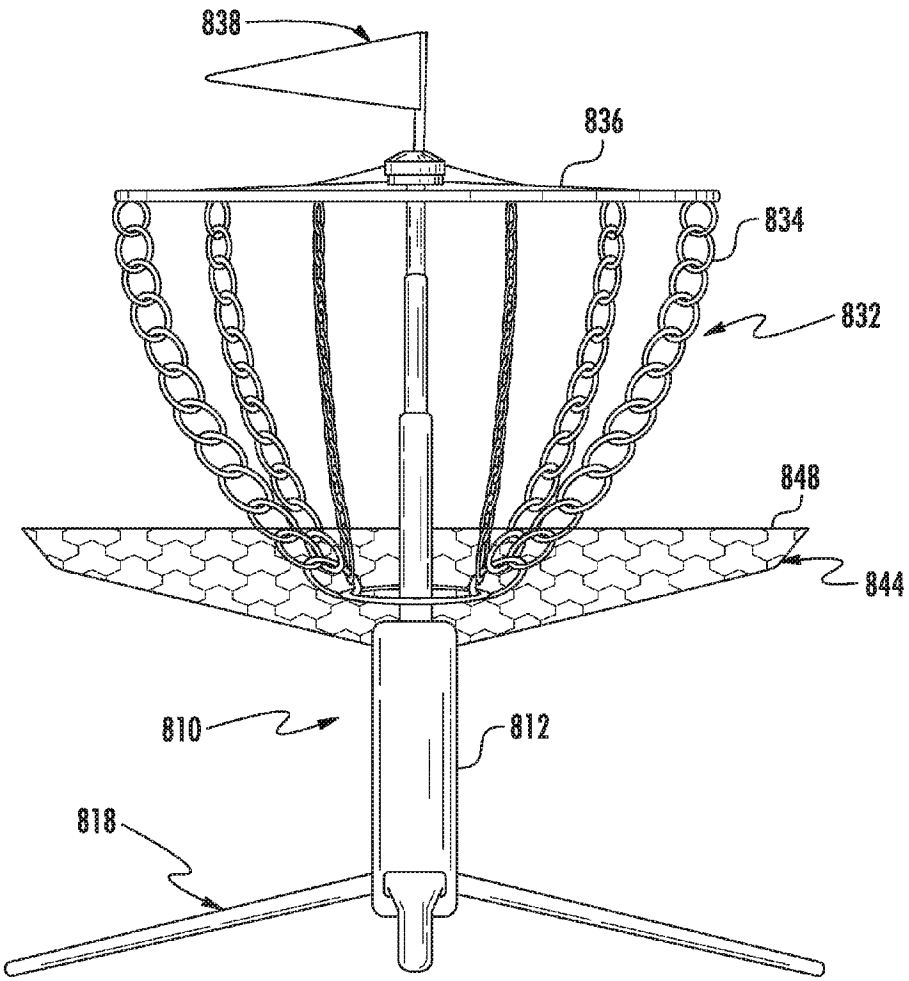
FIG. 7 is a front plan view of the additional variation of the engagement apparatus of the present invention shown in FIG. 6.
Figure 6:
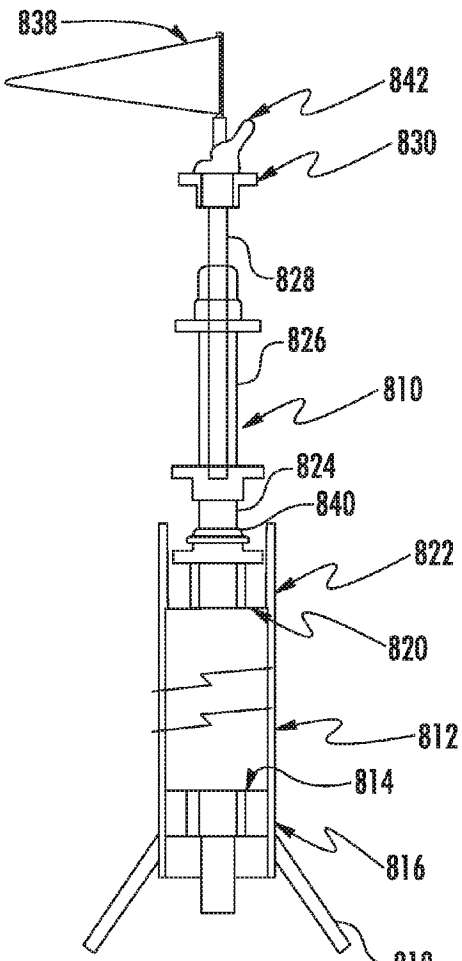
FIG. 6 is a sectional perspective view of a portion of an additional variation of the engagement apparatus of the present invention.
Figures 8A, 8B, 8C:
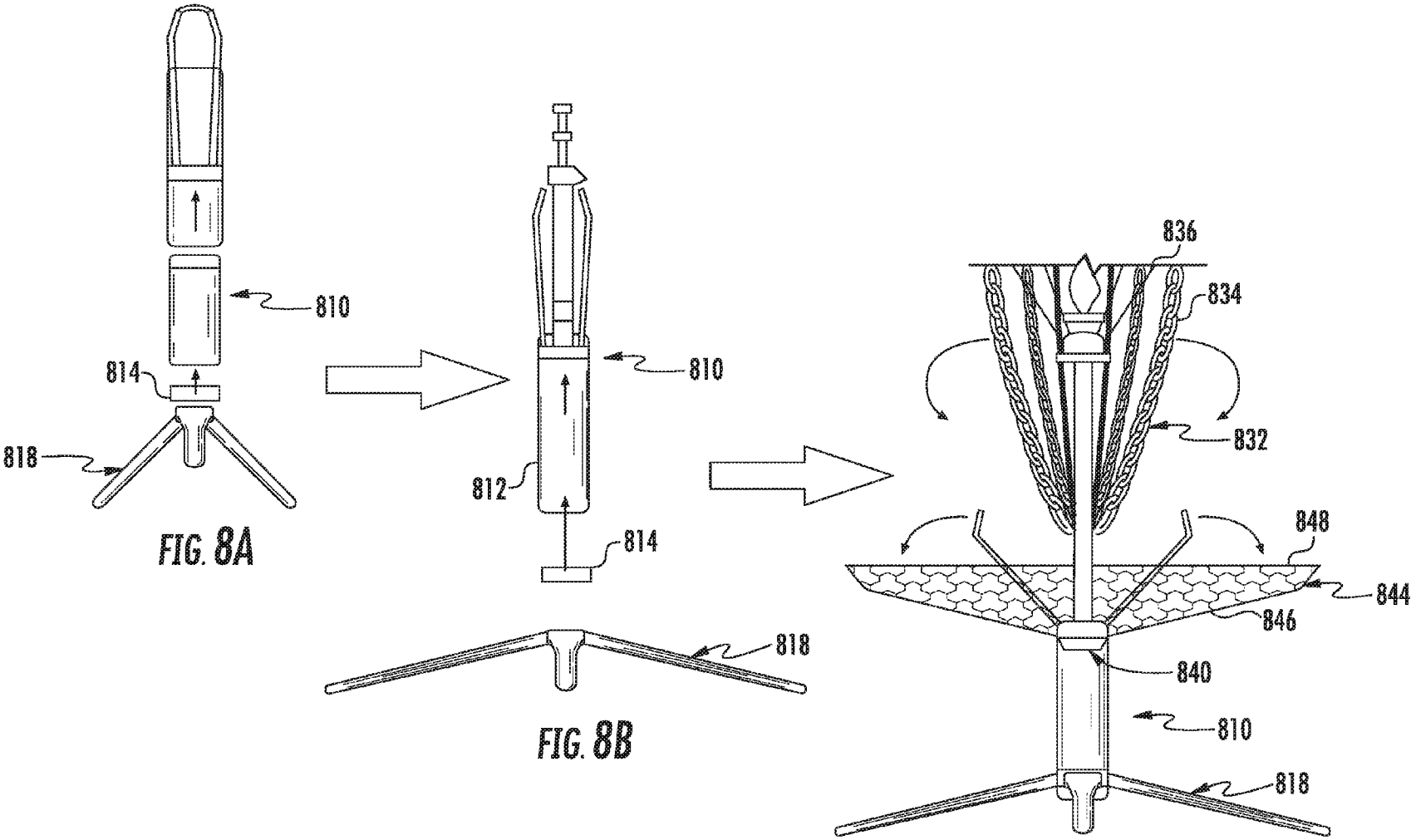
FIGS. 8A-C are schematic front elevational views of the additional variation of the engagement apparatus of the present invention shown in FIG. 6 and showing the conversion of the additional variation of the engagement apparatus from its carry case mode to its target deployment mode.

Reference is now had to an additional variation of the engagement apparatus of the present invention which is shown in FIG. 6, FIG. 7, and FIGS. 8A-C. FIG. 6 is a sectional perspective view of a portion of the additional variation of the engagement apparatus of the present invention in its target deployment mode, FIG. 7 is a front plan view of the additional variation of the engagement apparatus of the present invention shown in FIG. 6, and FIGS. 8A-C are schematic front elevational views of the additional variation of the engagement apparatus of the present invention shown in FIG. 6 and showing the conversion of the additional variation of the engagement apparatus from its carry case mode to its target deployment mode. In the additional variation of the engagement apparatus of the present invention, the second riser section 224 of the pylon assembly 220 of the catch device 110 is configured with a plurality of telescoping posts in lieu of a single non-telescoping post. The additional variation of the engagement apparatus of the present invention includes a catch device 810 that has a hollow cylindrical tube 812 having a twenty four inch (24 inch) axial length and a stem having an enlarged radius section sized compatibly with the inner circumference of the tube 812 such that the stem can be slidably retracted into the tube 812 and can be slidably extended from the tube 812 until engaging an inwardly extending lower stopper on the inner wall of the tube. The tube 812 has three circumferentially equally spaced notches 816 that accommodate the three legs of a tripod 818 such that the tripod 818 stably supports the stem in an upright position. The tripod 818 includes an annular base plate 814 sized in correspondence with the hollow cylindrical tube 812 such that the base plate 814 has a diameter slightly less that the inner diameter of the tube 812. The annular base plate 814 of the tripod 818 includes a spring biased pushbutton 816 for releasably engaging a stop bore in the lower axial portion of the tube 812 such that the annular base plate 814 of the tripod 818 can be retained by the tube 812 at a fixed axial location from which the legs of the tripod can extend radially outwardly.

The catch device 810 also includes a basket piston 820 slidably mounted within the tube 812 and having an enlarged radius section sized compatibly with the inner circumference of the tube 812 such that the basket piston 820 can be slidably moved within the tube 812 in the direction from the upper axial end of the tube toward the lower axial end of the tube and can be slidably moved within the tube 812 in the direction from the lower axial end of the tube toward the upper axial end of the tube until engaging an inwardly extending upper stopper on the inner wall of the tube. The stem is comprised of a lower pole section 822, a middle pole section 824, and an upper pole section 826. The enlarged radius section of the basket piston 820 has a spring biased pushbutton 822 for releasably engaging a stop bore in the upper axial portion of the tube 812 such that the basket piston 820 can be releasably maintained at an axial location of the tube 812 that permits the lower pole section 824 threadably coupled to the basket piston 820 to extend beyond the upper axial end of the tube. The relatively smaller diameter middle pole section 826 is slidably mounted therein for extension outwardly from, and retraction into, the lower pole section 822. The relatively smaller diameter upper pole section 826 is slidably mounted therein for extension outwardly from, and retraction into, the middle pole section 824. A canopy runner 830 is fixedly mounted to an upper axial portion of the upper pole section 826 and has a pull strap 842 secured thereto. As seen in FIG. 7, the canopy 832 has a plurality of hanging chains 834 and ribs 836 and is deployable between a collapsed disposition and a spread out disposition and the ribs 836 are hingedly connected to the canopy runner 830. A flag 838 is slidably mounted to the upper axial end of the upper pole section 826 such that the flag 838 can be extended outwardly from, and retracted into, the upper pole section 826.

A basket runner 840 is fixedly secured to the lower pole section 822 and has a pull strap secured thereto. A collection basket 844 includes a plurality of basket ribs 846 each hingedly connected to the basket runner 840 and a mesh fabric portion 848 that is secured to the basket ribs 846. The collection basket 844 is deployable between a collapsed disposition in which it can be fully accommodated within the tube 812 and a spread out disposition in which it extends preferably radially outwardly beyond the radial spread of the canopy 832 at a position axially intermediate the canopy 832 and the tripod 818. A user can manually deploy the collapsed collection basket 844 by pulling the pull strap 842 connected to the canopy runner 830 to move the basket piston 820 relative to the tube 812 until the spring biased pushbutton 822 releasably engages the stop bore in the upper axial portion of the tube 812 and the user can deploy the collapsed canopy 832 by pulling the pull strap 842 connected to the canopy runner 830, thereby telescoping the middle pole section 824 and the upper pole section 826 to their full extensions. The user can pull the pull strap connected to the basket runner 840 to bring the collection basket 844 to its spread out disposition.

Figure 9:
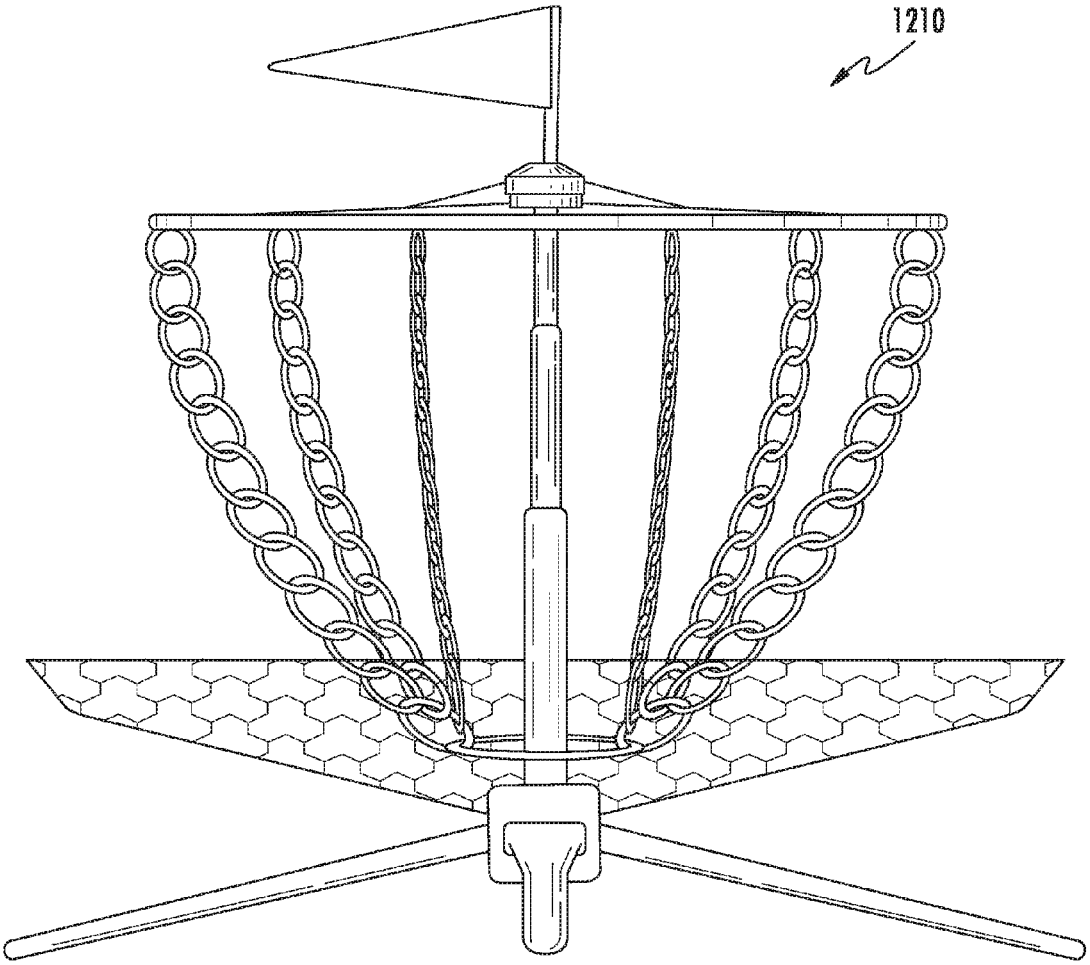
FIG. 9 is a perspective view of yet another variation of the engagement apparatus of the present invention.

As seen in FIG. 9, which is a perspective view of yet another variation of the engagement apparatus of the present invention, a catch device 1210 has a first riser section of the pylon assembly that is configured with a relatively short axial length—i.e., a length sufficient to accommodate the mounting of the first traveler and, if desired, a mount for the tripod legs of the support component 550. This configuration enables the catch device 1210 to have a relatively reduced overall axial length in its playing position and thus renders the catch device suitable for portable support on, for example, a picnic table—if it is desired to simulate the actual normal height of a target intercepting device—or on the ground or a floor surface.

In each of the versions of the engagement apparatus described herein, the pylon assembly 220 can be formed, for example, of molded or thermoformed plastic or polymeric material. It will be readily appreciated, however, that other suitable materials are possible, such as, for example, a lightweight aluminum or alloy composition material, a fiberglass-reinforced material, or any other suitable polymeric or composite material. In addition, the pylon assembly 220 can, in addition to its support function in association with the interceptor 330 and the receipt component 440, provide a protective cover function in that the pylon assembly can be configured to receive the interceptor 330 and the receipt component 440 in a rigid, semi-rigid, or flexible housing that protects the interceptor 330 and the receipt component 440 against limited crush forces, against moisture and debris intrusion, and against bending or flexing. Also, the pylon assembly 220 beneficially minimizes the risk of losing a piece or a part when the engagement apparatus is being stored or deployed, as the entireties of the interceptor 330 and the receipt component 440 are enclosed within the pylon assembly 220 when the engagement apparatus has been broken down and collapsed into the pylon assembly for storage. One exemplary configuration of the pylon assembly 220 that permits it to serve both its support function and its protective cover function includes a configuration of the first riser section 222 as a rigid open ended tube having sufficient interior volume to accommodate the interceptor 330 and the receipt component 440 fully within the axial extent of the first riser section 222. The first riser section 222 shown in FIG. 1-3A is shown in this configuration, wherein the first riser section 222 shown in FIG. 2 is a rigid open ended tube having overall cylindrical inner and outer peripheries. If, for example, the first riser section 222 shown FIG. 1-3A is formed of a suitable impact resistance material such as, for example, a suitable injection molded plastic, the first riser section 222 will resist a range of unwanted impact forces as well as resist, in cooperation with the overcaps 662, 664, moisture or debris penetration. Alternatively, the catch device 110 can be provided with a protective cover capability that is separate from the pylon assembly 220. For example, a water resistant textile fabric carry bag may be provided that has an interior volume sufficient to receive therein the catch device 110 in its carry case position. This configuration may be suitable, for example, in the event that the pylon assembly 220 does not comprise any components capable of receiving the other components of the pylon assembly in an interior portion—i.e., both the first riser section 222 and the second riser section 224 are formed of relatively small diameter shaft portions.

Figure 10C:
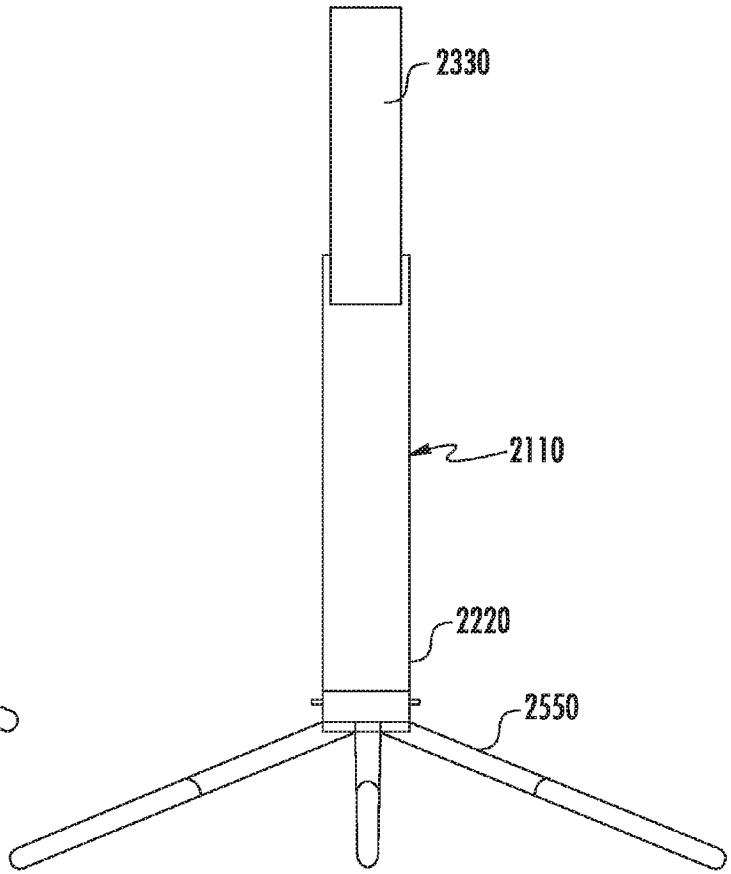
FIGS. 10A-C are schematic front elevational views of a first variation of the engagement apparatus of the present invention having an interceptor with a dual function structure and showing the conversion of this variation of the engagement apparatus from its carry case mode to its target deployment mode.
Figure 10B:
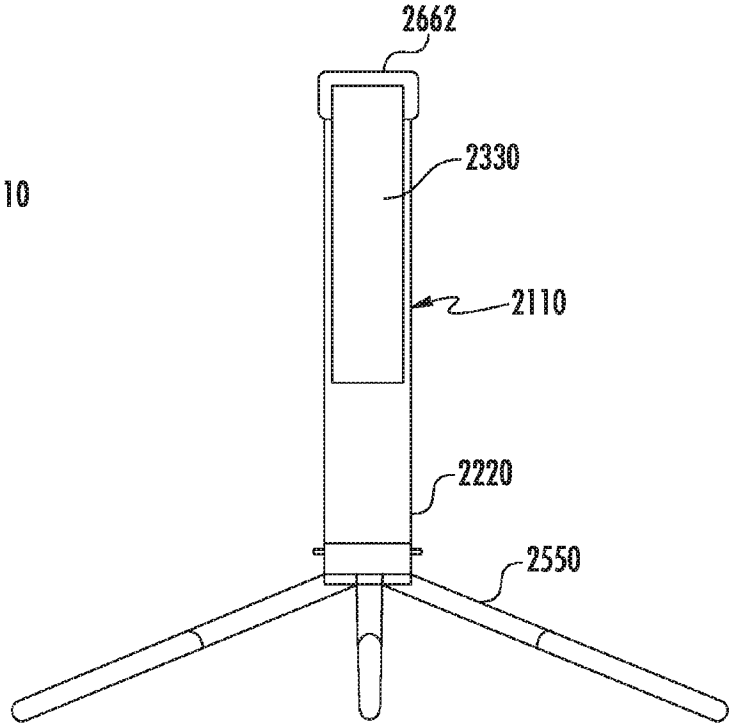
Figure 10A:
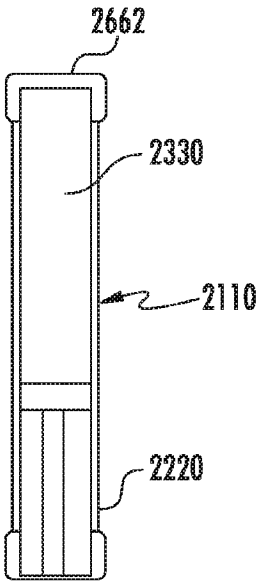

Reference is now had to three configurations of a variation of the engagement apparatus of the present invention having an interceptor with a dual function structure. Reference is had initially to FIGS. 10A-C, each of which are schematic front elevational views of the first variation of the engagement apparatus of the present invention having an interceptor with a dual function structure and showing the conversion of this variation of the engagement apparatus from its carry case mode to its target deployment mode. A target device 2110 is operable to present a target for a thrown object such as, for example, a flying disc or a bell, and the target device 2110 registers a hit of the thrown object by providing visual signal feedback to the user. The target device 2110 includes a pylon assembly 2220 and an interceptor 2330. The target device 2110 further includes a ground support assembly 2550 that supports the pylon assembly 2220 and the interceptor 2330 in their upright dispositions in a target deployment mode of the target device 2110. The target device 2110 is convertible between a target deployment mode and a carry case mode, as will be described in more detail herein.

The pylon assembly 2220 can be formed, for example, of injection molded or extruded polymeric materials or plastic and can be fully rigid, semi-rigid, or substantially non-rigid. The interceptor 2330 can also be formed, for example, of injection molded or extruded polymeric materials or plastic and can be fully rigid, semi-rigid, or substantially non-rigid and the interceptor 2330 is configured to be nested completely within the pylon assembly 2220 in the carry case mode and to slide outwardly from the pylon assembly in the target deployment mode until the principal extent of the interceptor projects above the top of the pylon assembly 2220. The interceptor 2330 is preferably formed of an open- or closed-cell polystyrene or polyurethane foam such as, for example, foam that is offered under the trademark Styrofoam. The open end of the pylon assembly 2220 is capped by an overcap 2662 when the target device 2110 is in its carry case mode. In the target deployment mode, the extent of the interceptor 2330 above the top of the pylon assembly 2220 presents a visual target towards which a user can throw a thrown object. The target device 2110 registers a hit of the thrown object on the interceptor 2330 by providing visual signal feedback to the user in that the interceptor 2330 resiliently deforms and/or bends when struck by the thrown object. The interceptor 2330 is formed as a closed-cell polystyrene cylinder.

Figure 11C:
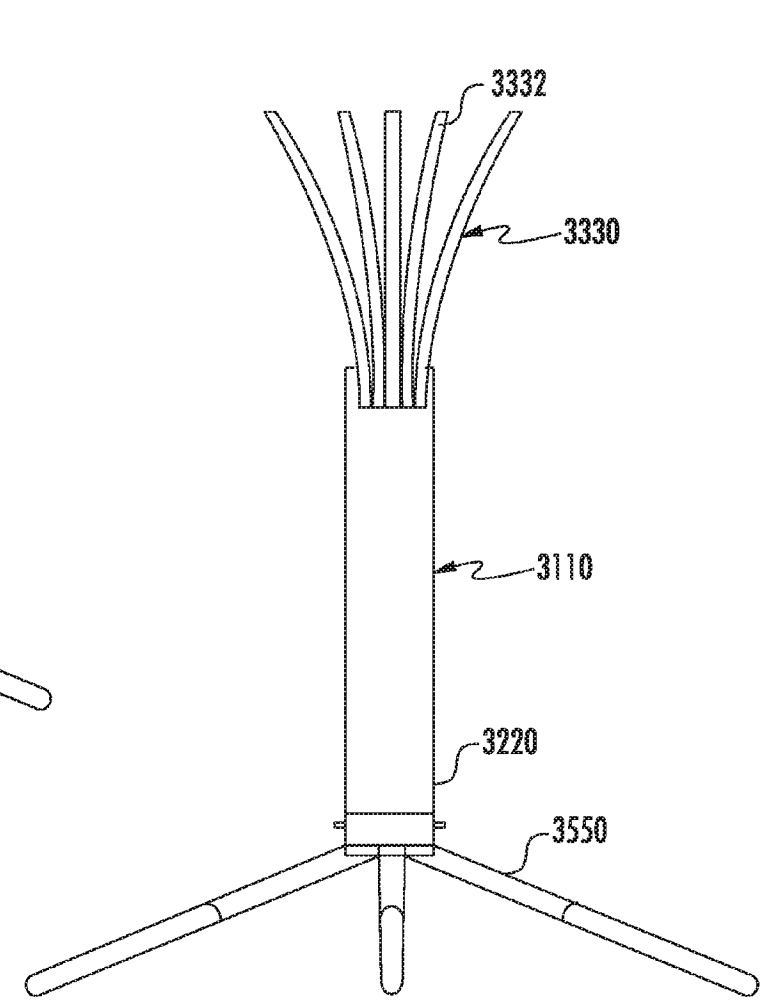
FIGS. 11A-C are schematic front elevational views of a second variation of the engagement apparatus of the present invention having an interceptor with a dual function structure and showing the conversion of this variation of the engagement apparatus from its carry case mode to its target deployment mode.
Figure 11B:
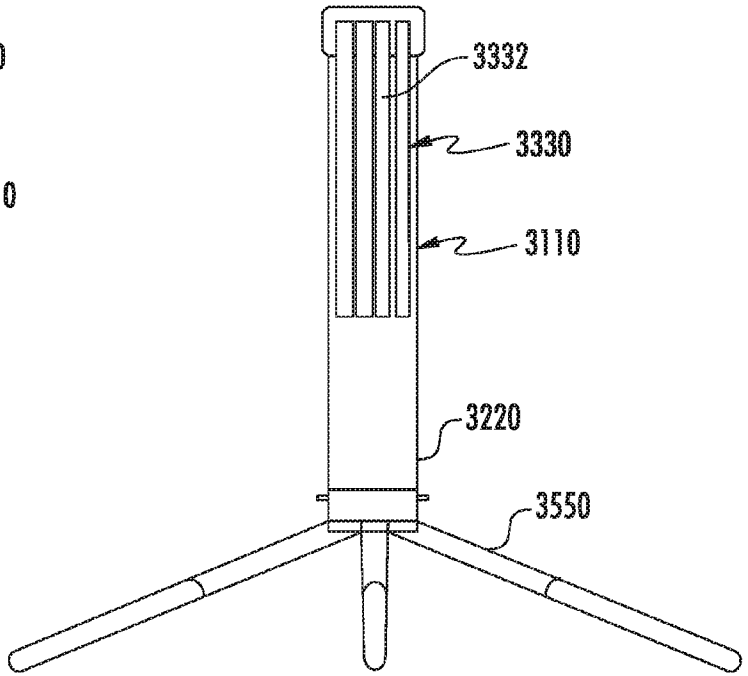
Figure 11A:
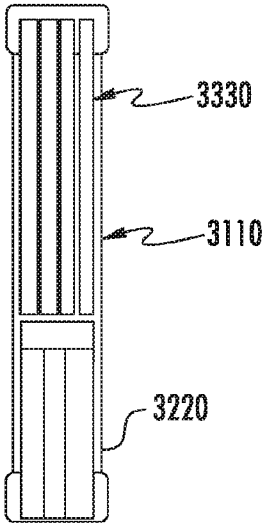

Turning now to FIGS. 11A-C, each of which are schematic front elevational views of the second variation of the engagement apparatus of the present invention having an interceptor with a dual function structure and showing the conversion of this variation of the engagement apparatus from its carry case mode to its target deployment mode, a target device 3110 is operable to present a target for a thrown object such as, for example, a flying disc or a ball, and the target device 3110 registers a hit of the thrown object by providing visual signal feedback to the user. The target device 3110 includes a pylon assembly 3220 and an interceptor 3330. The target device 3110 further includes a ground support assembly 3550 that supports the pylon assembly 3220 and the interceptor 3330 in their upright dispositions in a target deployment mode of the target device 3110. The target device 3110 is convertible between a target deployment mode and a carry case mode, as will be described in more detail herein.

The pylon assembly 3220 and the interceptor 3330 can be formed, for example, of injection molded or extruded polymeric materials or plastic and can be fully rigid, semi-rigid, or substantially non-rigid. The interceptor 3330 is configured to be nested completely within the pylon assembly 3220 in the carry case mode and to slide outwardly from the pylon assembly in the target deployment mode until the principal extent of the interceptor projects above the top of the pylon assembly 3220. The interceptor 3330 is preferably formed of an open- or closed-cell polystyrene or polyurethane foam such as, for example, foam that is offered under the trademark Styrofoam. In the target deployment mode, the extent of the interceptor 3330 above the top of the pylon assembly 3220 presents a visual target towards which a user can throws a thrown object. The target device 3110 registers a hit of the thrown object on the interceptor 3330 by providing visual signal feedback to the user in that the interceptor 3330 resiliently deforms and/or bends when struck by the thrown object. The interceptor 3330 is formed of a plurality of closed-cell polystyrene foam segments that are commonly connected to one another at their lower axial ends such that the closed-cell polystyrene foam segments 3332 form a cylinder having a hollow interior. The closed-cell polystyrene foam segments can be commonly connected to one another at their lower axial ends via, for example, adhesive securement of each closed-cell polystyrene foam segment to the adjacent closed-cell polystyrene foam segments or securement to a cylindrical collar (not shown). Thus, the closed-cell polystyrene foam segments of the interceptor 3330 project above the top of the pylon assembly 3220 in the target deployment mode and present a visual target towards which a user can throws a thrown object. One or more of the closed-cell polystyrene foam segments of the interceptor 3330 may resiliently deform and/or bend when struck by the thrown object.

Figure 12C:
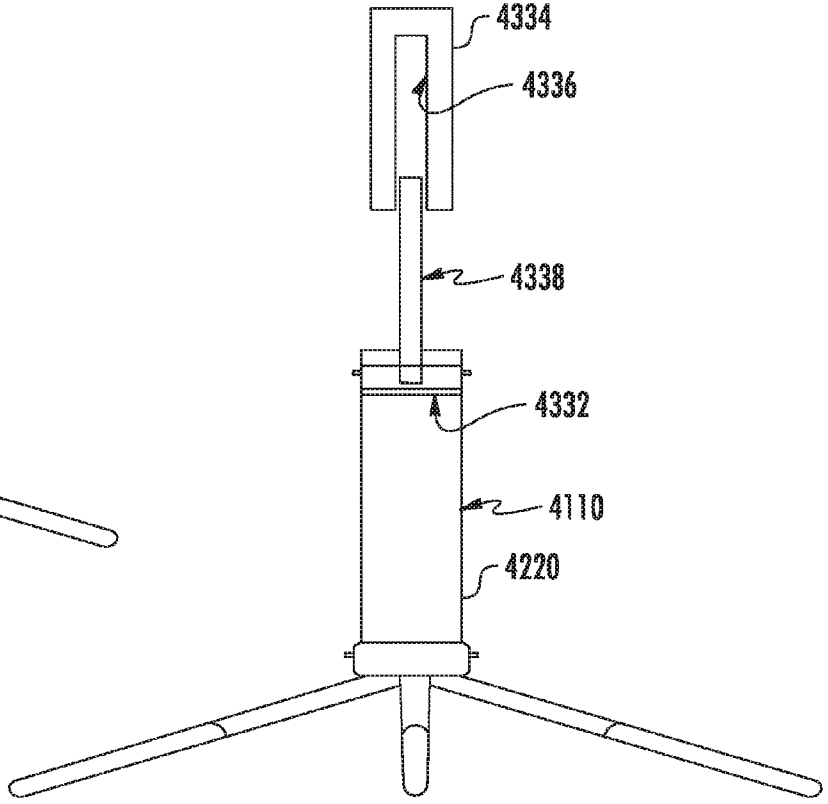
FIGS. 12A-C are schematic front elevational views of a third variation of the engagement apparatus of the present invention having an interceptor with a dual function structure and showing the conversion of this variation of the engagement apparatus from its carry case mode to its target deployment mode.
Figure 12B:
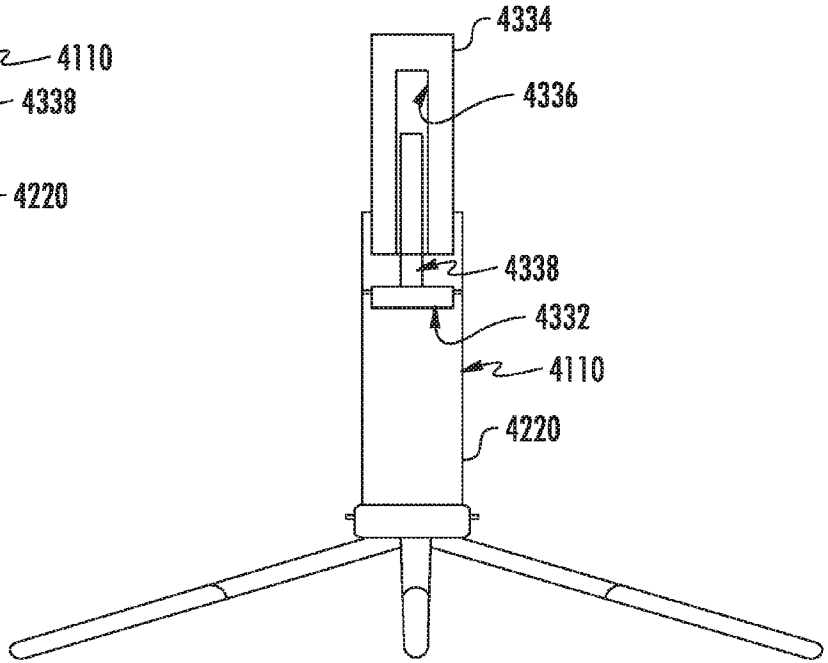
Figure 12A:
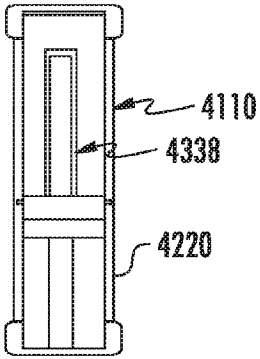

Reference is now had to FIGS. 12A-C, each of which are schematic front elevational views of the third variation of the engagement apparatus of the present invention having an interceptor with a dual function structure and showing the conversion of this variation of the engagement apparatus from its carry case mode to its target deployment mode. A target device 4110 is operable to present a target for a thrown object such as, for example, a flying disc or a ball, and the target device 4110 registers a hit of the thrown object by providing visual signal feedback to the user. The target device 4110 includes a pylon assembly 4220 and an interceptor 4330. The target device 2110 further includes a ground support assembly 4550 that supports the pylon assembly 4220 and the interceptor 4330 in their upright dispositions in a target deployment mode of the target device 4110. The target device 4110 is convertible between a target deployment mode and a carry case mode, as will be described in more detail herein.

The pylon assembly 44220 and the interceptor 4330 can be formed, for example, of injection molded or extruded polymeric materials or plastic and can be fully rigid, semi-rigid, or substantially non-rigid. The interceptor 4330 is configured to be nested completely within the pylon assembly 4220 in the carry case mode and to slide outwardly from the pylon assembly in the target deployment mode until the principal extent of the interceptor projects above the top of the pylon assembly 4220. The interceptor 4330 is configured to be nested completely within the pylon assembly 4220 in the carry case mode and to slide outwardly from the pylon assembly in the target deployment mode until the principal extent of the interceptor projects above the top of the pylon assembly 4220. The interceptor 4330 is formed of a piston 4332 and a sleeve 4334 with the sleeve 4334 preferably formed of an open- or closed-cell polystyrene or polyurethane foam such as, for example, foam that is offered under the trademark Styrofoam. The sleeve 4334 is cylindrical and has a cylindrical slot 4336 extending axially at its centerline and open at one axial end of the sleeve.

The piston 4332 has a cylindrical base that is configured in correspondence with the inner cylindrical surface of the pylon assembly 4220 to slide relative thereto in a smooth yet stable manner. A piston rod 4338 projects from the cylindrical base of the piston 4332 and receives the cylindrical slot 4336 of the sleeve 4334 inserted thereover. In the target deployment mode, the cylindrical base of the piston 4332 is slid toward the top of the pylon assembly 4220, whereupon the piston rod 4338 of the piston 4332 and receives the cylindrical slot 4336 projects beyond the top of the pylon assembly 4220 and the sleeve 4334 slides relatively along the piston rod 4338 of the piston 4332 to project above the top of the pylon assembly 4220 and present a visual target towards which a user can throw a thrown object. The target device 4110 registers a hit of the thrown object on the interceptor 4330 by providing visual signal feedback to the user in that the interceptor 4330 resiliently deforms and/or bends when struck by the thrown object. The interceptor 4330 is formed as a closed-cell polystyrene cylinder.

The exemplary shapes, dimensions, sizes, number of features, and materials described herein are provided by way of example only. Targets for thrown objects can be fabricated in shapes, dimensions and using different component, sizes and materials and having a greater or lesser number of features than those discussed and illustrated herein also are contemplated as being within the scope of the present invention.

Although this invention has been disclosed and described in its preferred forms with a certain degree of particularity, it is to be realized that the optimum dimensional relationships for the parts of the invention, to include variations in size, materials, shape, form, function and manner of operation, assembly and use, are deemed readily apparent and obvious to one skilled in the art. Additionally, it is understood that the present disclosure of the preferred forms is only by way of example and that numerous changes in the details of operation and in the combination and arrangement of parts may be resorted to without departing from the spirit and scope of the invention as hereinafter claimed.

The invention claimed is:

1. An engagement apparatus for engaging a thrown object such as a flying disc, the engagement apparatus comprising:

a pylon assembly, the pylon assembly having a first riser section and a second riser section and the pylon assembly having an axis and having a base axial end and a distal axial end, the first riser section delimiting the base axial end and the second riser section delimiting the distal axial end, and the first riser section and the second riser section being disposable between a stowage disposition in which the first riser section and the second riser section are at least partially co-extensive with one another relative to the axial direction and together delimit a stowage axial length measured from the base axial end delimited by the first riser section to the distal axial end delimited by the second riser section an operating disposition in which the first riser section and the second riser section collectively extend to an operating length greater than the stowage axial length;

a surface presenting component, the surface presenting component being operable to present a surface on which a thrown object can be engaged and having a mounting portion; and a traveler operable to movably couple the mounting portion of the surface presenting component to the pylon assembly, the traveler guiding a movement of the surface presenting component relative to the pylon assembly in which the surface presenting component moves between a non-presenting position in which the mounting portion of the surface presenting component is at a first axial spacing from the base axial end of the pylon assembly and a presenting position in which the mounting portion of the surface presenting component is at a second axial spacing from the base axial end of the pylon assembly that is greater than the first axial spacing.

2. The engagement apparatus according to claim 1, wherein the surface presenting component is an interceptor and further comprising a receipt component, the receipt component having a receiving surface on which a thrown object is retained after the thrown object has been engaged by the interceptor, the interceptor in its presenting position extending radially from the pylon assembly to a projecting radial spacing and in its non-presenting position extending from the pylon assembly to a lesser radial spacing than the projecting radial spacing, and the interceptor and the receipt component being securable to the pylon assembly in the operating disposition of the pylon assembly such that the receipt component is axially intermediate the base axial end of the pylon assembly and the interceptor.

3. The engagement apparatus according to claim 2, wherein the receipt component is disposable between a flared position in which the receipt component extends radially from the pylon assembly to a flared radial spacing and a pack position in which the receipt component extends from the pylon assembly to a lesser radial spacing than the flared radial spacing and the pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

4. The engagement apparatus according to claim 3, wherein the interceptor includes a plurality of chain link segments.

5. The engagement apparatus according to claim 1, wherein the surface presenting component is a receipt component, the receipt component having a receiving surface on which a thrown object is retained after the thrown object has been engaged by the receipt component, the receipt component in its presenting position extending radially from the pylon assembly to a projecting radial spacing and in its non-presenting position extending from the pylon assembly to a lesser radial spacing than the projecting radial spacing, and further comprising an interceptor and the interceptor and the receipt component being securable to the pylon assembly in the operating disposition of the pylon assembly such that the receipt component is axially intermediate the base axial end of the pylon assembly and the interceptor.

6. The engagement apparatus according to claim 5, wherein the interceptor is disposable between an intercepting position in which the interceptor extends radially from the pylon assembly to a projecting radial spacing and a non-intercepting position in which the interceptor extends from the pylon assembly to a lesser radial spacing than the projecting radial spacing and the pylon assembly, the interceptor, and the receipt component are operatively associated with one another such that a movement of the pylon assembly from is operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

7. The engagement apparatus according to claim 6, wherein the interceptor includes a plurality of chain link segments.

8. A catch device for catching a thrown object such as a flying disc, the catch device comprising:

a pylon assembly, the pylon assembly having a first riser section and a second riser section and the pylon assembly having an axis and having a base axial end and a distal axial end, the first riser section and the second riser section being disposable between a stowage disposition in which the first riser section and the second riser section are at least partially co extensive with one another relative to the axial direction and collectively extend to a stowage length and an operating disposition in which the first riser section and the second riser section collectively extend to an operating length greater than the stowage length;

an interceptor; and a receipt component, the receipt component having a receiving surface on which a thrown object is retained after the thrown object has been engaged by the interceptor, the interceptor and the receipt component being securable to the pylon assembly in the operating disposition of the pylon assembly such that the receipt component is axially intermediate the base axial end of the pylon assembly and the interceptor, the interceptor being disposable between an intercepting position in which the interceptor extends radially from the pylon assembly to a projecting radial spacing and a non-intercepting position in which the interceptor extends from the pylon assembly to a lesser radial spacing than the projecting radial spacing, the receipt component being disposable between a flared position in which the receipt component extends radially from the pylon assembly to a flared radial spacing and a pack position in which the receipt component extends from the pylon assembly to a lesser radial spacing than the flared radial spacing, and the pylon assembly, the interceptor, and the receipt component being operatively associated with on another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

9. The catch device according to claim 8, wherein the first riser section radially surrounds at least a portion of at least one of the interceptor in its non-intercepting position and the receipt component in its pack position.

10. The catch device according to claim 9 and further comprising a traveler connected to at least one of the interceptor and the receipt component, the traveler being operatively associated with the pylon assembly such that it engages the pylon assembly to axially guide the at least one of the interceptor and the receipt component in a movement of the at least one of the interceptor and the receipt component from its respective intercepting position or its flared position to its respective non-intercepting position or pack position.

11. The catch device according to claim 10, wherein the traveler releasably maintains at least one of the interceptor and the receipt component in its respective intercepting position or its flared position at a given axial spacing from the base axial end of the pylon assembly and moves axially relative to the base axial end of the pylon assembly to a different axial spacing from the base axial end of the pylon assembly in connection with a movement of the at least one of the interceptor and the receipt component from its respective intercepting position or its flared position to its respective non-intercepting position or pack position.

12. The catch device according to claim 10, wherein at least one of the interceptor and the receipt component is the receipt component, the first riser section radially surrounds at least a portion of the receipt component in its pack position, the first riser section has a rim, and, once the traveler no longer maintains the receipt component at the given axial spacing from the base axial end of the pylon assembly, a movement of the receipt component axially toward the base axial end of the pylon assembly causes the receipt component to pivot about the rim of the first riser section, thereby assisting the receipt component to move from its flared position to its pack position.

13. An engagement apparatus for engaging a thrown object such as a flying disc, the engagement apparatus comprising:

a pylon assembly, the pylon assembly having a first riser section and a second riser section and the pylon assembly having an axis and having a base axial end and a distal axial end, the first riser section delimiting the base axial end and the second riser section delimiting the distal axial end, and the first riser section and the second riser section being disposable between a stowage disposition in which they delimit a stowage axial length measured from the base axial end delimited by the first riser section to the distal axial end delimited by the distal axial end and an operating disposition in which the first riser section and the second riser section collectively extend to an operating length greater than the stowage axial length;

an interceptor, the interceptor being operable to present a surface on which a thrown object can be engaged and having a mounting portion; and a traveler operable to movably couple the mounting portion of the interceptor to the pylon assembly, the traveler guiding a movement of the interceptor relative to the pylon assembly in which the interceptor moves between a non-presenting position in which the mounting portion of the interceptor is at a first axial spacing from the base axial end of the pylon assembly and a presenting position in which the mounting portion of the interceptor is at a second axial spacing from the base axial end of the pylon assembly that is greater than the first axial spacing and the interceptor in its presenting position extending radially from the pylon assembly to a projecting radial spacing and in its non-presenting position extending from the pylon assembly to a lesser radial spacing than the projecting radial spacing; and a receipt component, the receipt component having a receiving surface on which a thrown object can be retained and the interceptor and the receipt component being securable to the pylon assembly in the operating disposition of the pylon assembly such that the receipt component is axially intermediate the base axial end of the pylon assembly and the interceptor.

14. The engagement apparatus according to claim 13, wherein the receipt component is disposable between a flared position in which the receipt component extends radially from the pylon assembly to a flared radial spacing and a pack position in which the receipt component extends from the pylon assembly to a lesser radial spacing than the flared radial spacing and the pylon assembly, the interceptor, and the receipt component are operatively associated with one another such that a movement of the pylon assembly from its operating disposition to its stowage disposition operates to move the interceptor and the receipt component axially closer to the base axial end of the pylon assembly and, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

15. The engagement apparatus according to claim 14, wherein the interceptor includes a plurality of chain link segments.

16. The engagement apparatus according to claim 13, wherein the surface presenting component is a receipt component, the receipt component having a receiving surface on which a thrown object is retained after the thrown object has been engaged by the receipt component, the receipt component in its presenting position extending radially from the pylon assembly to a projecting radial spacing and in its non-presenting position extending from the pylon assembly to a lesser radial spacing than the projecting radial spacing, and further comprising an interceptor and the interceptor and the receipt component being securable to the pylon assembly in the operating disposition of the pylon assembly such that the receipt component is axially intermediate the base axial end of the pylon assembly and the interceptor.

17. The engagement apparatus according to claim 16, wherein, when the pylon assembly is in its stowage disposition, the interceptor has been moved from its intercepting position into its non-intercepting position, and the receipt component has been moved from its flared position into its pack position, the interceptor and the receipt component at least partially axially overlap one another.

18. The engagement apparatus according to claim 17, wherein the interceptor includes a plurality of chain link segments.

* * * * *